US009975135B1

(12) United States Patent
Hertel, III et al.

(10) Patent No.: US 9,975,135 B1
(45) Date of Patent: May 22, 2018

(54) LIGHTWEIGHT APPARATUS FOR CAPTURING OVERSPRAY AND AIRBORNE PARTICULATES

(71) Applicants: William M. Hertel, III, Annapolis, MD (US); Richard J. Norcross, Darnestown, MD (US)

(72) Inventors: William M. Hertel, III, Annapolis, MD (US); Richard J. Norcross, Darnestown, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days. days.

(21) Appl. No.: 15/356,417

(22) Filed: Nov. 18, 2016

Related U.S. Application Data

(60) Provisional application No. 62/256,834, filed on Nov. 18, 2015.

(51) Int. Cl.
*B05B 15/04* (2006.01)
*B05B 15/12* (2006.01)

(52) U.S. Cl.
CPC ..... *B05B 15/1229* (2013.01); *B05B 15/1214* (2013.01); *B05B 15/1248* (2013.01)

(58) Field of Classification Search
USPC ..... 118/326, 309, 634, DIG. 7; 454/56–67
See application file for complete search history.

(56) References Cited

U.S. PATENT DOCUMENTS

| | | | | |
|---|---|---|---|---|
| 3,251,177 | A * | 5/1966 | Baker | B25H 1/20 454/56 |
| 4,325,319 | A * | 4/1982 | Richards | B05B 5/082 118/630 |
| 5,489,234 | A | 2/1996 | Hockett | |
| 5,688,323 | A | 11/1997 | Kane et al. | |
| 8,499,716 | B2 | 8/2013 | Norcross | |

* cited by examiner

*Primary Examiner* — Yewebdar T Tadesse
(74) *Attorney, Agent, or Firm* — Dave Ghatt

(57) ABSTRACT

The invention is directed to a lightweight apparatus for the redirection and capture of paint overspray and airborne particulates at a surface being painted. The apparatus has a top tubing arrangement, and a bottom tubing arrangement, and blowers that provide air to both tubing arrangements. The invention also has an enclosure having a top opening and a bottom opening. The bottom tubing arrangement is positioned at the bottom opening. The bottom tubing arrangement includes a plurality of perforations creating an airflow that provides a pneumatic seal between the apparatus and the surface being painted, preventing the escape of paint overspray. The top tubing arrangement also includes a plurality of perforations that create an airflow that prevents the escape of paint overspray from the enclosure. Entrained paint overspray and airborne particles within the enclosure are captured by a filter within the enclosure.

4 Claims, 9 Drawing Sheets

LIGHTWEIGHT APPARATUS FOR CAPTURING OVERSPRAY AND AIRBORNE PARTICULATES

CROSS-REFERENCE TO RELATED APPLICATIONS

This application claims the benefit of U.S. Provisional Application No. 62/256,834 filed Nov. 18, 2015, which is incorporated herein by reference.

STATEMENT OF GOVERNMENT INTEREST

The following description was made in the performance of official duties by employees and/or contractors of the Department of the Navy, and, thus the claimed invention may be manufactured, used, licensed by or for the United States Government for governmental purposes without the payment of any royalties thereon.

TECHNICAL FIELD

The invention is directed to a lightweight disposable perforated apparatus for the redirection and capture of paint overspray and airborne particulates.

BACKGROUND

Large structures, such as ships, buildings, bridges, all deteriorate slowly when exposed to the environment. Paints and other coatings are typically applied to the surfaces of these structures to prevent or diminish the harmful effects of the environment. Typically, these coatings include minerals such as lead, zinc, tin, copper, or other heavy metal-based paints. The application of these paints or coatings, particularly via spray mechanisms can be harmful to the environment, as minute particles called overspray, are inadvertently released.

During spray paint application, a portion of the paint does not adhere to the surface. This "overspray" moves largely parallel to the surface and carries heavy metals and other hazardous materials into the environment that endangers waterways, plants, animals, humans, and contaminates nearby structures. Overspray can be defined in two categories; academic overspray, and feather overspray.

Regarding ships and protecting against the release of overspray during painting cycles, shipyards have traditionally resorted to enshrouding entire ships. Enshrouding a ship is expensive in material, labor, and time and interferes with other necessary ship maintenance activities, with reduces overall productivity. Consequently, there has been a development of various arrangements, including; automated painting machines with localized overspray capture shrouds and portable enclosures with broader overspray capture for use with a manual painter. Automated machines tend to be expensive and do not apply paint on curved surface as effectively as compared to when paint is manually applied.

Portable enclosures for use with manual painters are typically heavy, bulky, and are generally flawed at capturing a high percentage of overspray. Typically these portable man-sized enclosures operate so that there is a gap between the enclosure and the surface being painted. For the most effective capturing of overspray, this gap must be "effectively" sealed by providing a controlled airflow in this area. The percentage of overspray capture, and conversely overspray spillage to the environment depends on the design features of the seal. It is desired to have a design that is easy to use, inexpensive, lightweight, and that captures a high percentage of overspray.

SUMMARY

In one aspect, the invention is an apparatus for the redirection and capture of paint overspray and airborne particulates at a surface being painted. In this aspect the apparatus has a top tubing arrangement, and a bottom tubing arrangement. The invention also has an enclosure having a top portion with a top opening within the top portion. The top tubing arrangement is positioned at the top opening. The enclosure also includes a bottom portion, wherein the entirety of the bottom portion forms a bottom opening. The bottom tubing arrangement is positioned at the bottom opening. The enclosure further includes a plurality of side portions between the top portion and the bottom portion. In this aspect, the apparatus includes a plurality of filters within the enclosure. The apparatus also has one or more blowers connected to each of the top tubing arrangement and the bottom tubing arrangement. The bottom tubing arrangement includes a plurality of perforations for directing air from the blower towards the surface to be painted, for creating a pneumatic seal between the apparatus and the surface being painted, for capturing said paint overspray and airborne particulates.

BRIEF DESCRIPTION OF THE DRAWINGS

Other features will be apparent from the description, the drawings, and the claims.

DETAILED DESCRIPTION

Figure 1A:
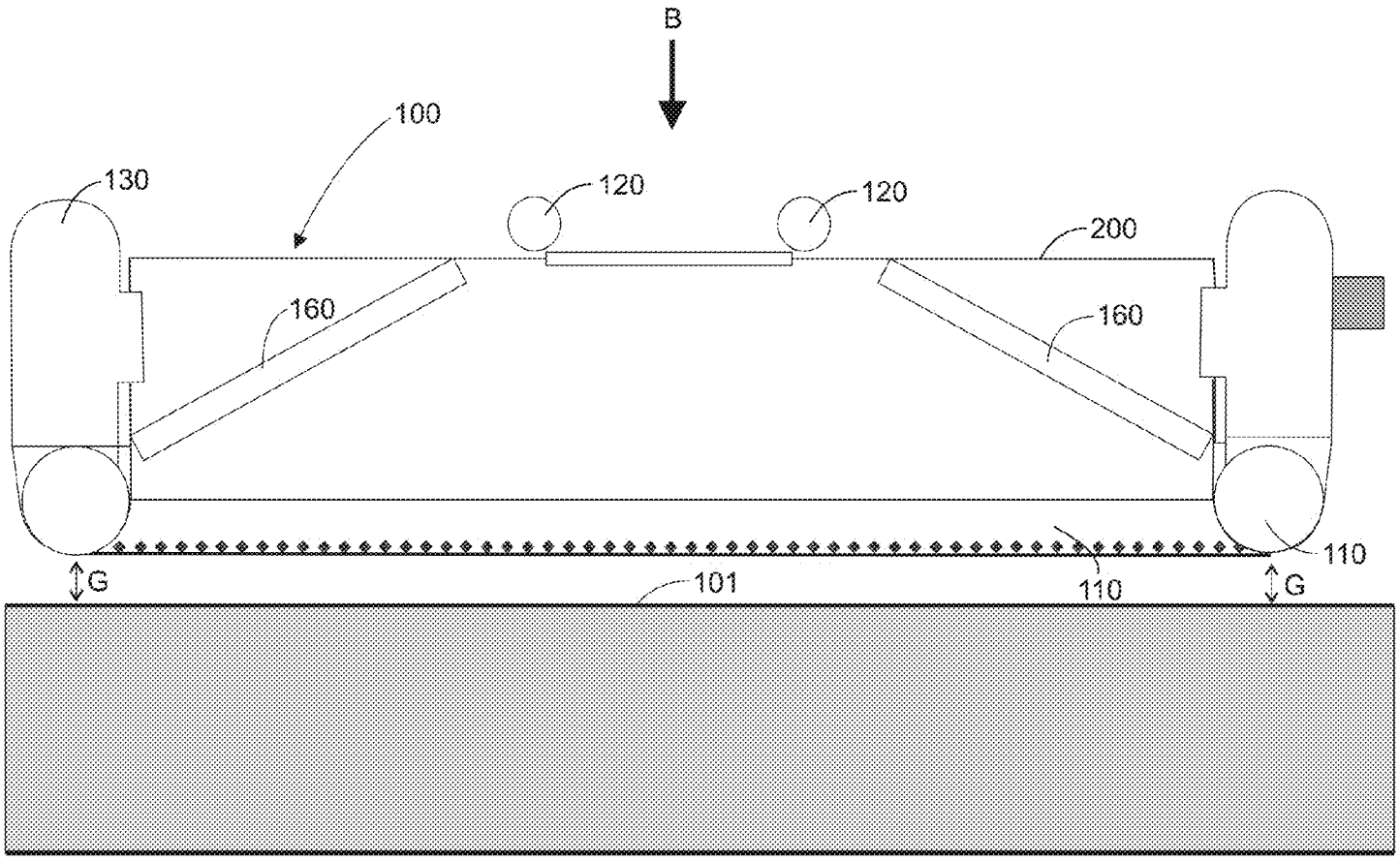
FIG. 1A is an exemplary sectional illustration of a device for the redirection and capture of overspray and airborne particulates, according to an embodiment of the invention.

FIG. 1A is an exemplary sectional illustration of a device 100 for the redirection and capture of overspray and airborne particulates, according to an embodiment of the invention. In operation, the device 100 is placed over a surface to be painted, without physically contacting that surface, and allows for both painting and the redirection and capture of paint overspray and airborne particulates. As outlined below, the device 100 is lighter, simpler, and requires less support structure and fewer components that what is known in the art, and thus is not inhibited by weight restrictions and is able to gain access to previously inaccessible locations.

FIG. 1A shows the device 100 for the redirection and capture of paint overspray and other airborne particulates, positioned over a surface 101 to be painted. For example, the surface 101 may be a building surface, a bridge surface, or an aircraft surface. According to an embodiment of the invention, the surface is a hull surface of a ship. In the operating position for applying paint to the surface 101, as shown, there is a physical gap G between the device 100 and the surface 101. According to an embodiment of the invention the gap G is about 4 inches±2 inches.

As outlined below, the device 100 may include attachments for securely attaching the device to a holding and/or moving mechanism for holding and moving the device 100 into an operating position and for maintaining the gap G between the device 100 and the surface 101. For example, a holding and/or moving mechanism may include a basket for holding the device, and a boom attached thereto for moving the device into position. When the device 100 is used to paint an elevated hull surface or an elevated building surface for example, the device 100 could be secured to a basket that is carried by a boom, with the arm of the boom moving the device into operating position.

Figure 1B:
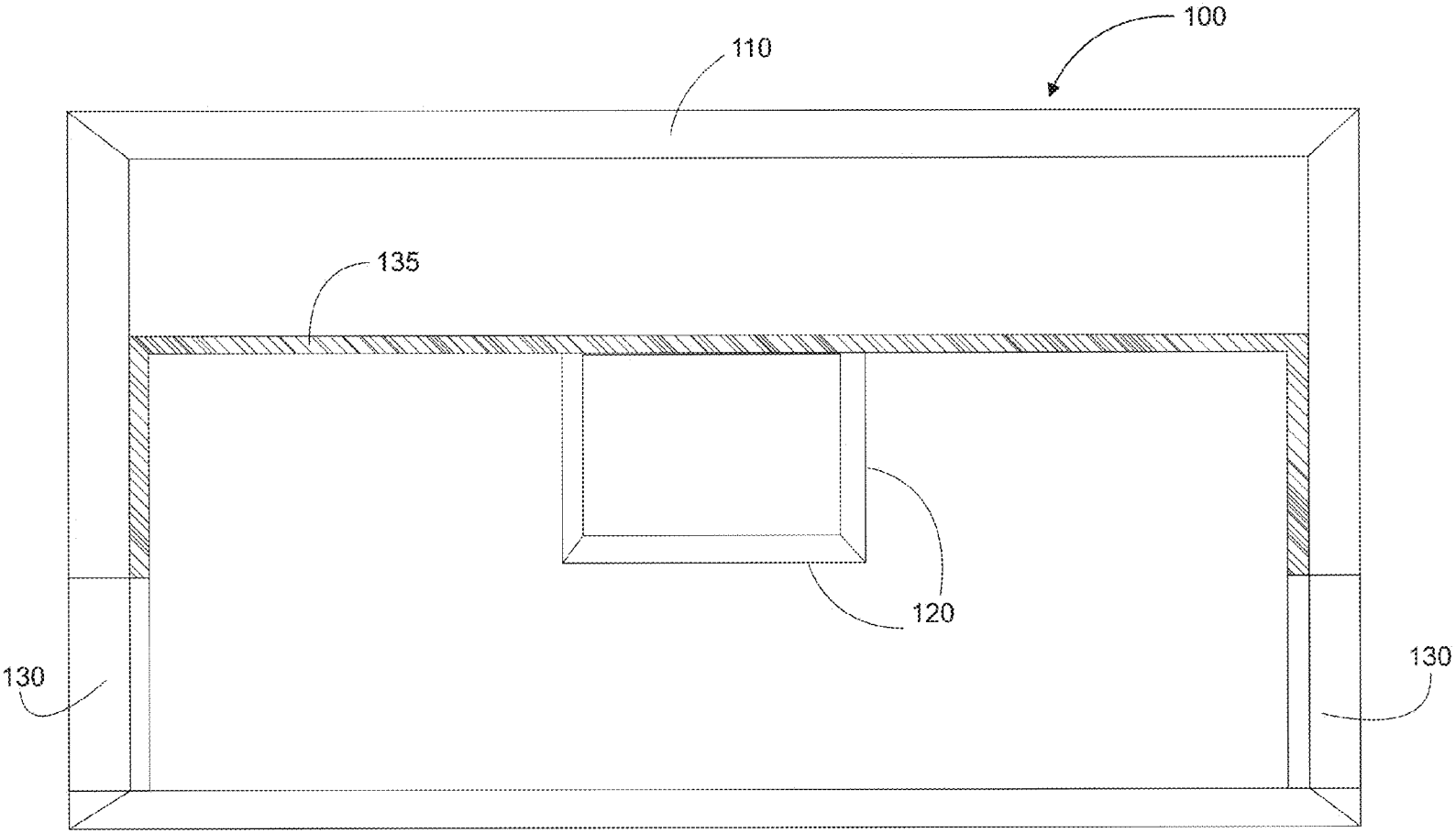
FIG. 1B is a simplified exemplary perspective illustration of the device, taken from the perspective of arrow B in FIG. 1A, according to an embodiment of the invention.

As outlined below, the device 100 includes an enclosure 200 that may be substantially rectanguloid. FIG. 1A shows a bottom tubing arrangement 110 and a top tubing arrangement 120, both arrangements contributing to the overall lightweight design. FIG. 1B is a simplified exemplary perspective illustration of the device 100, taken from the perspective of arrow B in FIG. 1A, and does not show all the features of the invention. FIG. 1B shows the bottom tubing arrangement 110 entirely extending around the perimeter of a bottom opening 140 at bottom the enclosure 200. It should be noted that the gap G is actually between the bottom tubing arrangement 110 and the surface 101. Having the lightweight tubing at this location is advantageous because the tubing 110 may act as a soft bumper, eliminating or reducing damage when there is inadvertent contact between the device 100 and surface 101. The tubing material for both bottom and top tubing arrangements 110 and 120 may be a soft light elastomeric material, such as polyethylene.

FIG. 1B also shows the top tubing arrangement 120 at the top opening/window 150 (outlined below). FIG. 1B shows the top tubing arrangement 120 having U-shape, i.e., extending around three sides of the window 150. However, according to other embodiments of the invention, the tubing arrangement 120 could extend entirely around the perimeter of the window 150, or could comprise two separate tubes that extend on opposite sides of the window 150. The bottom and top openings 140 and 150 are more clearly visible in the perspective view of FIG. 2, outlined below.

Both FIGS. 1A and 1B show blowers 130, which provide air to the bottom and top tubing arrangements 110 and 120. FIGS. 1A and 1B show the blowers directly connected to the bottom tubing arrangement 110. FIG. 1B shows the blowers 130 connected to the top tubing arrangement 120 via an air conduit 135. The blowers 130 may be any known lightweight blower, such as for example, PlasTec 30s, and may be powered by electric or air motors. According to an embodiment of the invention, the blowers 130 are powered by 1.25 kW (1.7 hp) air motors. Other motors having different power values may also be used. Although FIGS. 1A and 1B show the blowers 130 positioned on the enclosure 200, according to other embodiments of the invention, the blowers 130 may be remotely located with respect to the enclosure 200, and may be connected to the tubing arrangements 110 and 120 via conduits, such as the conduit 135 shown in FIG. 1B.

As stated above, the blowers 130 are connected to the tubing arrangements 110 and 120, for blowing air into the tubing arrangements 110 and 120. As outlined below, the tubing arrangements 110 and 120 each include perforations that are positioned to create a desired airflow. The airflow through the tubing arrangement 110 at the first opening 140 creates a pneumatic seal between the device 100 and the surface, preventing the escape of paint overspray and airborne particulates from the gap G between the surface and the bottom tubing arrangement 110 of the device 100 at the first opening 140. The airflow through the tubing arrangement 120 at the window 150 also directs air from the blower towards inner portions of the enclosure, preventing paint overspray and other airborne particulates from escaping through the window 150, keeping the overspray and particulates within the enclosure 200.

FIG. 1A shows filters 160. The filters 160 may be any known filter, typically used for capturing paint overspray, and may be attached to the enclosure 200 by known attachment devices. According to an embodiment of the invention, the filters 160 are common 2" tackified polyester paint booth filters attached to the apparatus with strips of hook tape with the filter forming the loop portion of a hook-and-loop fastener. It should be noted that the air blowers 130 withdraw air from within the enclosure to feed the tubing arrangement 110 and 120. The filters 160 are positioned as shown, so that when the blowers 130 withdraw air from the enclosure 200, the air is drawn through the filters 160, which helps to capture paint overspray trapped within the enclosure.

Figure 2A:
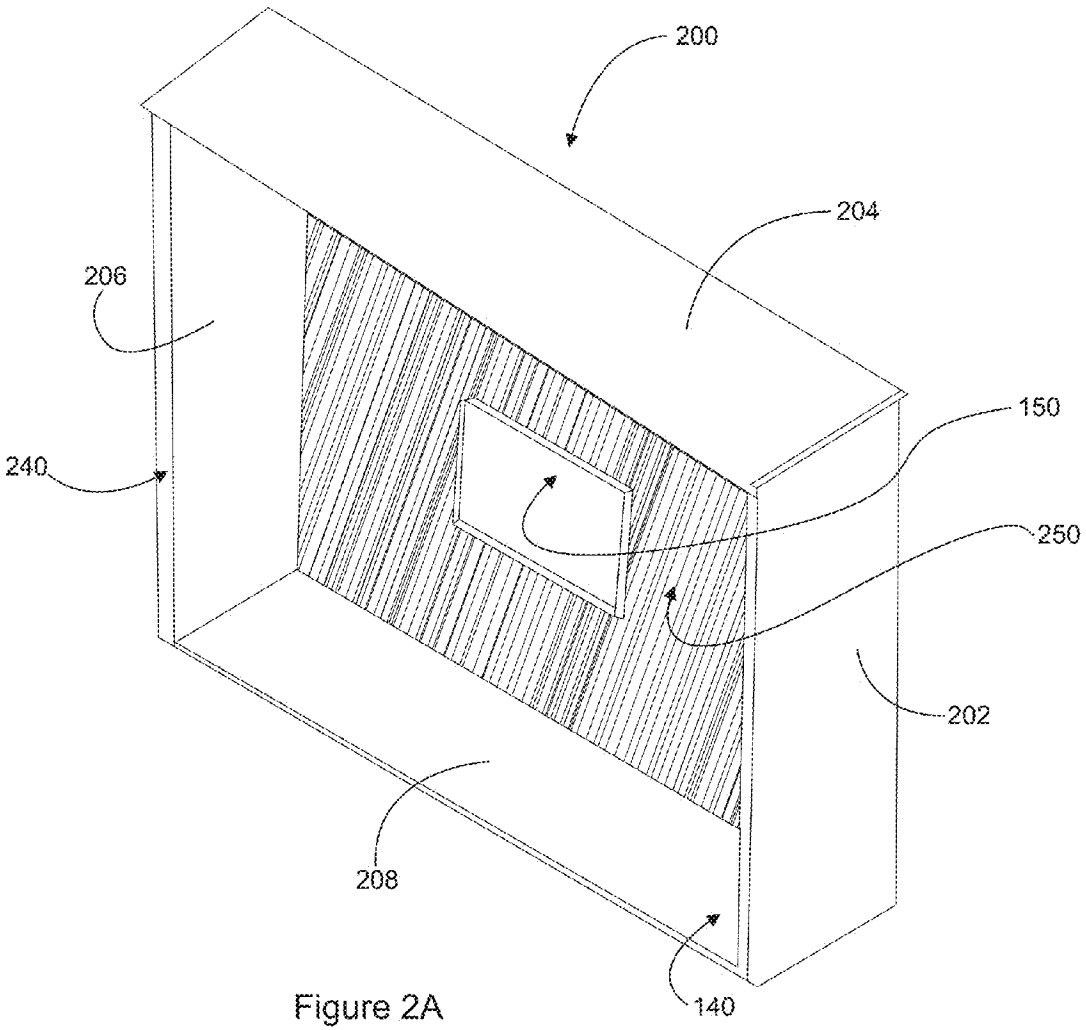
FIG. 2A is an exemplary simplified perspective view of the enclosure, according to an embodiment of the invention.

FIG. 2A is an exemplary simplified perspective view of the enclosure 200, according to an embodiment of the invention. As stated above, the device 100 is a lightweight device, and thus, the enclosure 200 is preferably made from a sturdy lightweight frame, covered with a shroud. The frame may be fabricated from fiberglass, high density polymers, and combinations thereof. As shown, the enclosure 200 is substantially rectanguloid, having side portions 202, 204, 206, and 208. FIG. 2A also shows the enclosure 200 with a bottom portion 240, at which the bottom opening 140 is formed. As shown, the entirety of the bottom portion 240 forms the bottom opening 140. FIG. 2A also shows the enclosure 200 having a top portion 250. The top opening/window 150 is formed within the top portion 250. Returning to FIGS. 1A and 1B, the tubing arrangements 110 and 120 are attached to the enclosure 200 about respective openings 140 and 150. Known clamping or other attachment devices may be used to attach the tubing arrangements 110 and 120 to the enclosure 200.

Figure 2B:
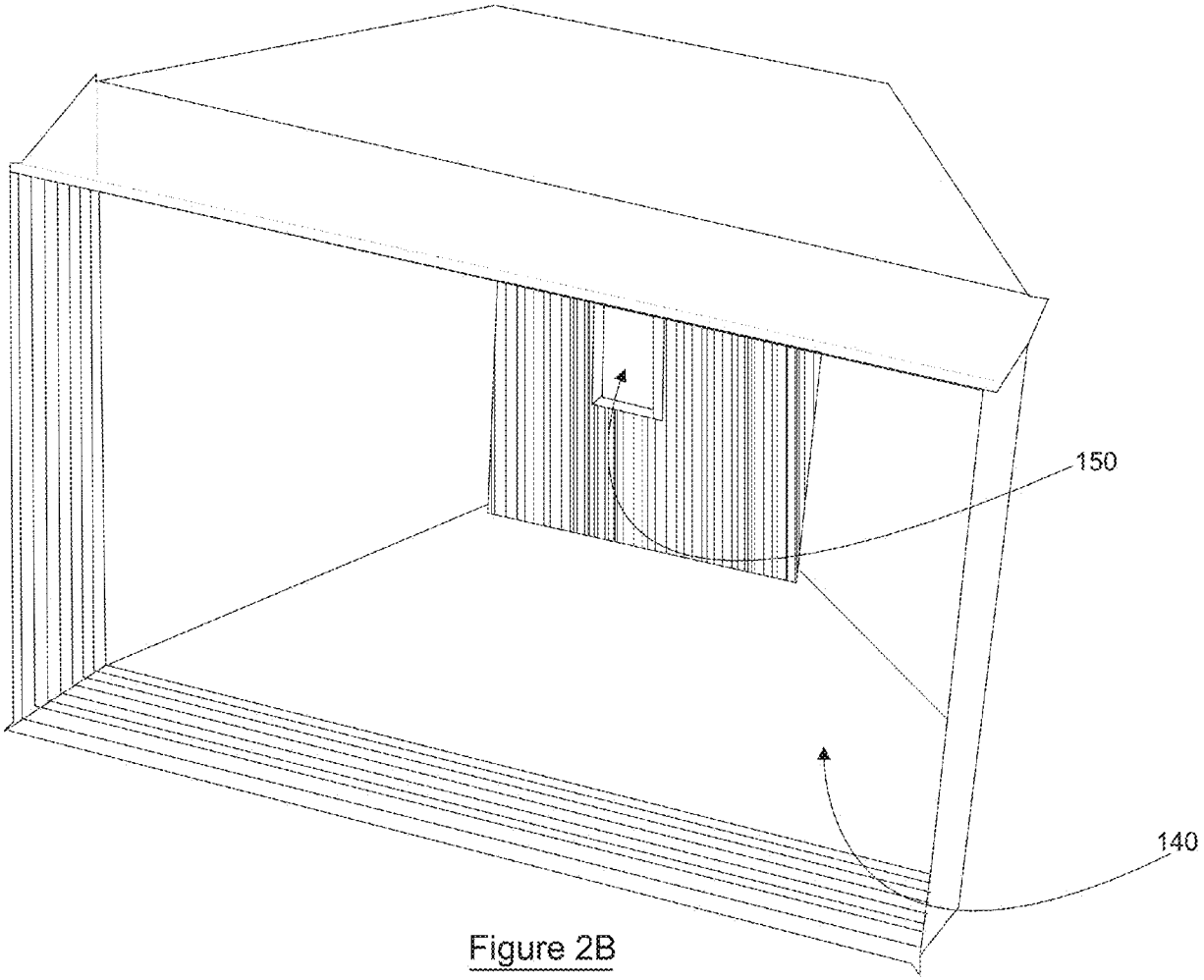
FIG. 2B is an exemplary simplified perspective view of the enclosure, according to an embodiment of the invention.

As stated above, FIG. 2A is a simplified illustration of the enclosure 200, showing generally the substantially rectanguloid shape, and how the openings 140 and 150 are positioned at the bottom and top portions 240 and 250, respectively. It should be noted that although the enclosure 200 has been illustrated as substantially rectanguloid, according to other embodiments of the invention, the enclosure 200 may have other shapes, such as cubic or frustoconical, or cylindrical, or combinations thereof. For example, FIG. 2B is an exemplary simplified perspective view of the enclosure 200 having a pyramid-like shape, according to an embodiment of the invention. The pyramid-like enclosure 200, according to this embodiment also includes bottom opening 140 and window 150, and in operation would work in a manner as outlined with respect to the rectanguloid enclosure of FIG. 2A. Regardless of the shape of the enclosure 200, as stated above, the enclosure 200 may include attachments for attaching the device 100 to a basket and boom mechanism, if required.

Figure 3A:
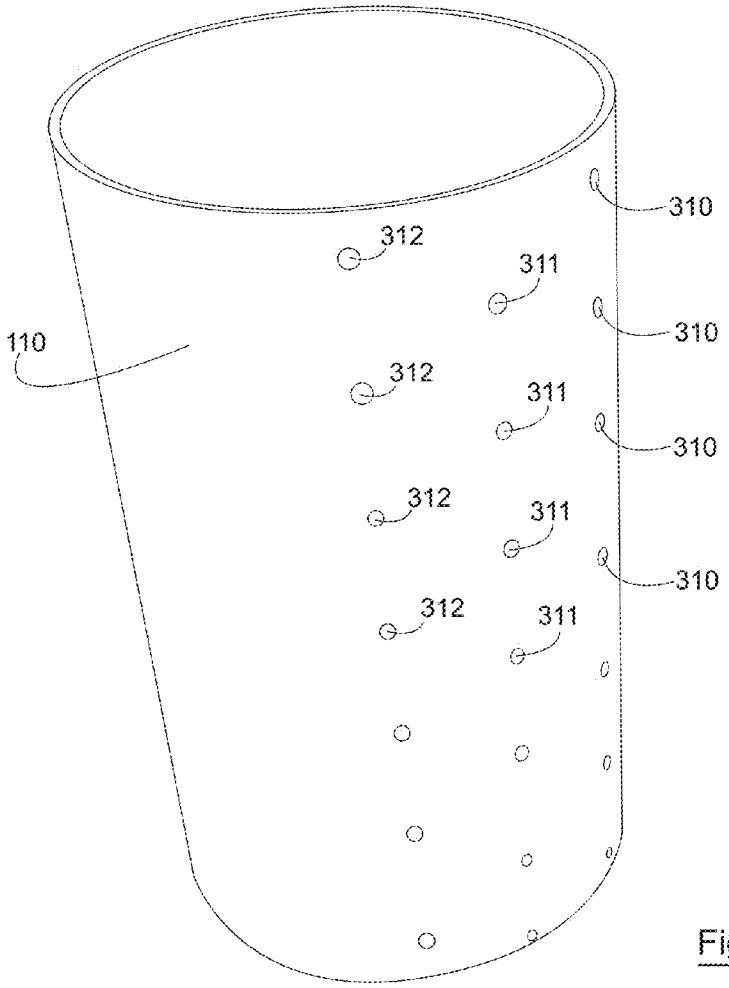
FIG. 3A is an exemplary illustration of the forward periphery tubing arrangement, showing the arrangement of perforations, according to an embodiment of the invention.

FIG. 3A is an exemplary illustration of the bottom tubing arrangement 110, showing the arrangement of perforations, according to an embodiment of the invention. As shown, the bottom tubing arrangement 110 has a plurality of perforations for directing air from the blower 130 towards the surface 101. As shown, the bottom tubing arrangement 110 has a plurality of columns of perforations including, an inner column of perforations 310, an outer column of perforations 312, and a middle column of perforations 311 between the inner and outer columns of perforations 310 and 312.

As outlined below, the middle column of perforations 311 are positioned so that air is directed directly downwards in a Y-direction, substantially perpendicular to the surface that is being painted. Also, shown below in FIG. 5A, the inner and outer column perforations 310 and 312 are positioned so that air is directed at an angle $\pm\alpha$ with respect to the Y-direction. As outlined below, perforations 310 direct air back into the apparatus 100. Perforations 312 dispel air out into the environment. And perforations 311 fill the area between 310 and 312. According to an embodiment of the invention, the perforations 310, 311, and 312 have a diameter of 0.5 inches, and are spaced at 1.5 inch intervals and 30° apart.

Figure 3B:
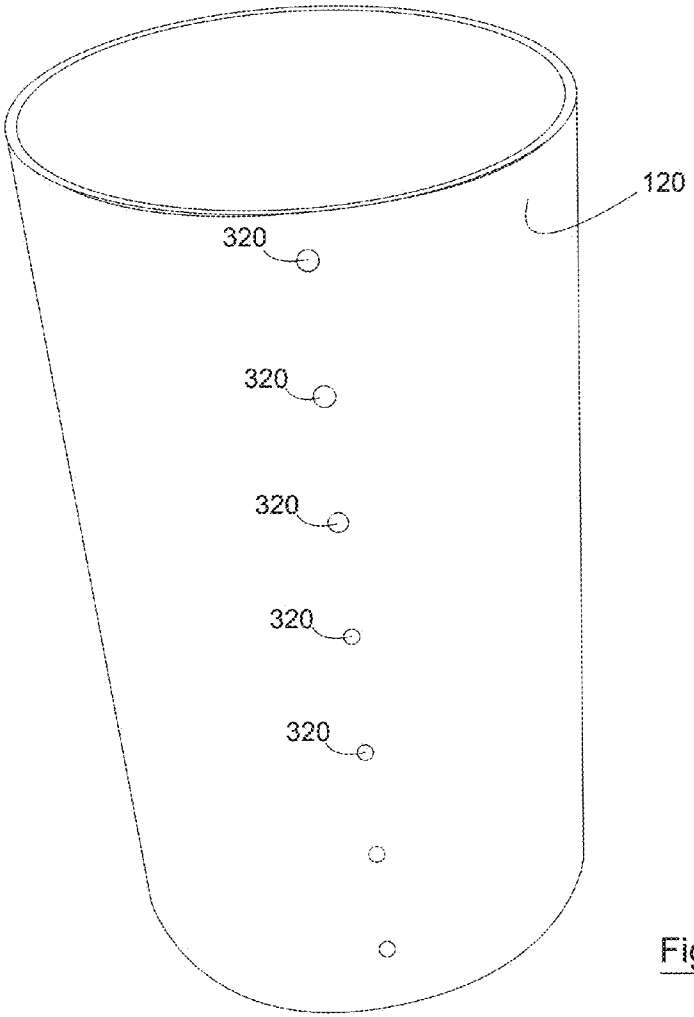
FIG. 3B is an exemplary illustration of the rear tubing arrangement 120, showing the arrangement of perforations, according to an embodiment of the invention.

FIG. 3B is an exemplary illustration of the top tubing arrangement 120, showing the arrangement of perforations, according to an embodiment of the invention. As shown, the top tubing arrangement 120 comprises a single top column of perforations 320 for directing air from the blower inwards and across the top opening. As shown below in FIG. 5A, the single top column of perforations 320 are positioned so that air is directed at an angle $\beta$ with respect to the Y-direction. In operation, the rate of airflow in the top tubing arrangement 110 is lower, as compared to the airflow in the bottom tubing arrangement 120. According to an embodiment of the invention, the single column of perforations 320 have 0.5 inch diameters and are spaced apart at 1.5 inch intervals.

Figure 4B:
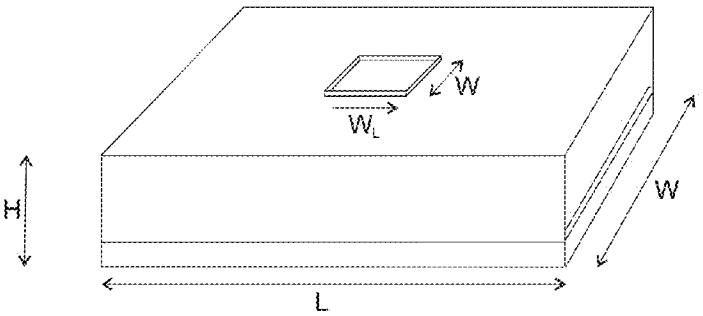
FIG. 4B is an exemplary illustration showing dimensions of the lightweight device for the redirection and capture of overspray and airborne particulates, according to an embodiment of the invention.
Figure 4A:
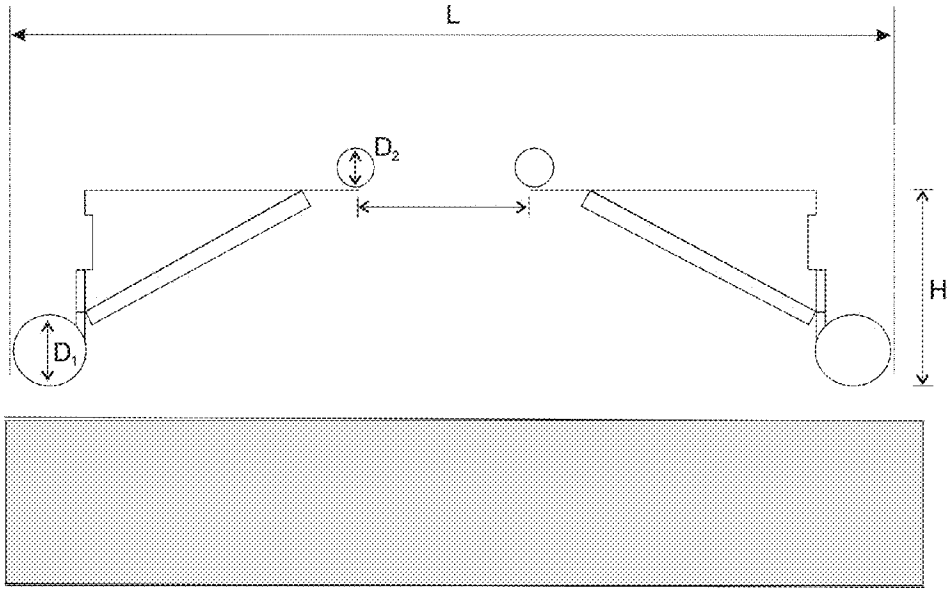
FIG. 4A is an exemplary illustration showing dimensions of the lightweight device for the redirection and capture of overspray and airborne particulates, according to an embodiment of the invention.

FIGS. 4A and 4B are exemplary illustrations showing dimensions of the lightweight device 100 for the redirection and capture of overspray and airborne particulates, according to an embodiment of the invention. As shown the device 100 has an overall length of L, a width of W, and a height H. It should be noted that the first opening 140 where the paint is applied has dimensions identical to the overall length and width, L and W. The second opening, window 150 has a length $W_L$ and a width $W_W$. FIGS. 4A and 4B also show the bottom tubing arrangement 110 having a diameter $D_1$, and the top tubing arrangement 120 having a diameter $D_2$.

According to an embodiment of the invention, at the first opening 140, the length L is about 4 ft. to about 12 ft., the width W is about 4 ft. to about 8 ft. and the height H is about 1 ft. to about 3 ft. According to one particular embodiment the length L is about 8 ft., the width W is about 6 ft., and the height H is about 2 ft. According to this embodiment, the second opening, window 150 has a length $W_L$ of about 20 inches to about 28 inches and a width $W_W$ of about 16 inches to about 24 inches. According to one particular embodiment, the second opening, window 150 has a length $W_L$ of about 23 inches and a width $W_W$ of about 23 inches.

Figure 5A:
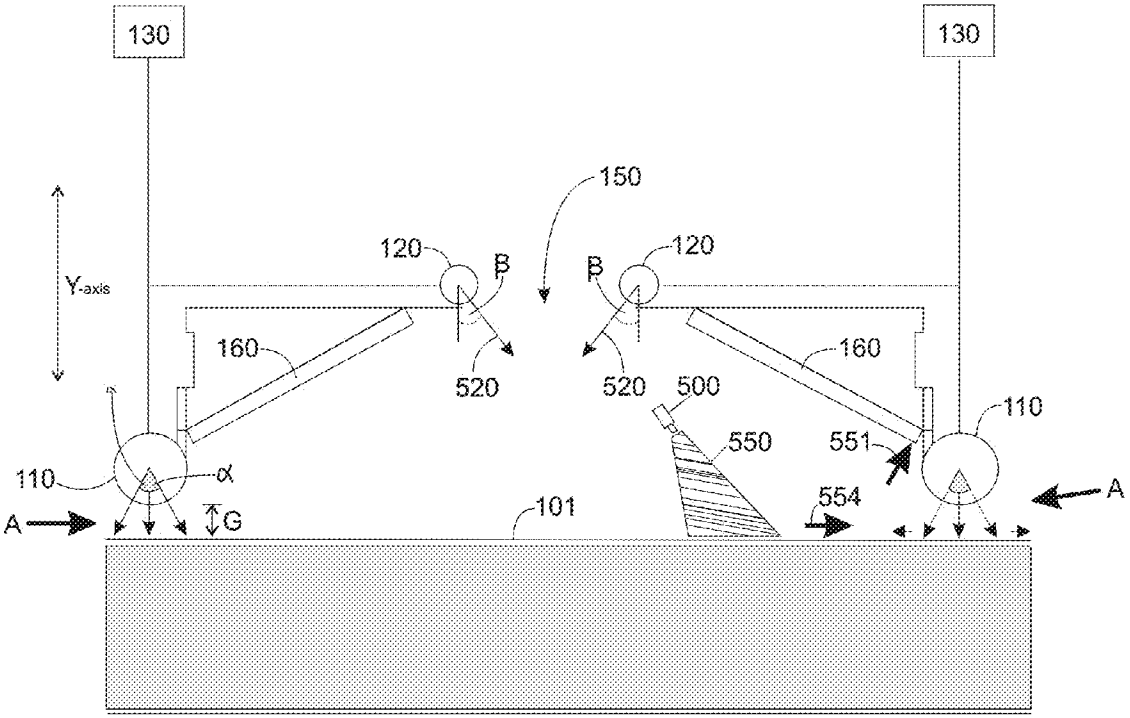
FIG. 5A is an exemplary explanatory illustration showing the operation of the lightweight device for the redirection and capture of overspray and airborne particulates, according to an embodiment of the invention.

FIG. 5A is an exemplary explanatory illustration showing the operation of the lightweight device 100 for the redirection and capture of overspray and airborne particulates, according to an embodiment of the invention. The FIG. 5A illustration shows the device 100 positioned over a surface 101 that is being painted. FIG. 5A shows a paint gun 500 spraying paint 550 onto the surface 101. FIG. 5A, also shows paint overspray 551 gathered at the surface 101. The blower 130, which may be remote, feeds air to the bottom tubing arrangement 110. The airflow at the bottom tubing arrangement 110 (shown at arrow A) creates a pneumatic seal, keeping the overspray 551 within the device. FIG. 5A also shows the single top column of perforations 320 directs the airflow 520 inwards and across the top opening/window 150 at an angle $\beta$ to prevent the escape of paint overspray. According to an embodiment of the invention angle $\beta$ is about 45°.

Note, while under ideal conditions the flow through the window 150 would always be inward, irregularities such as a cross breeze or misalignments may cause a small outflow in the absence of the airflow from 120. FIG. 5A also shows the entrained overspray 550 being directed back through the filters 160 where the particles in the overspray are captured. As stated above, the air blowers 130 withdraw air from within the enclosure 200 to feed the tubing arrangement 110 and 120, which draws the air through the filters 160, allowing the entrained paint overspray and airborne particles to be captured by the filters 160. FIG. 5A shows the entrained overspray 550 being directed back through the filters 160 where the particles in the overspray are captured.

Figure 5B:
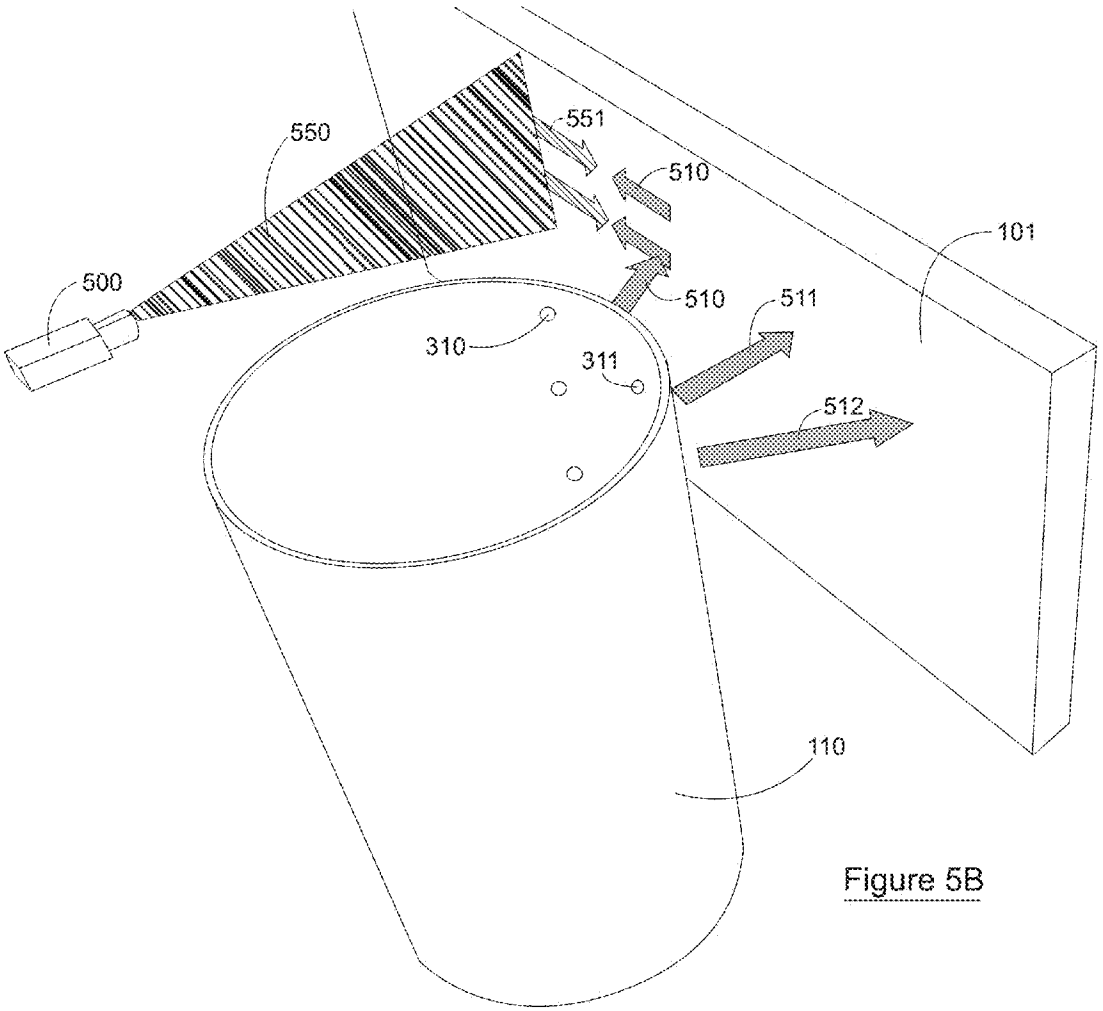
FIG. 5B is an exemplary explanatory illustration showing a close-up of the flow from the different columns of perforations that function to seal and entrain the paint overspray, according to an embodiment of the invention.

FIG. 5B is an exemplary explanatory illustration at arrow A in FIG. 5A, showing a close-up of the flow from the different columns of perforations (310, 311, and 312 shown in FIG. 3A) that function to seal and entrain the paint overspray 551. As shown, the airflows (510, 511, and 512) from the different columns provide a seal between the tubing 110 (and consequently the device 100) and the surface 101. The airflow 510 from the inner column 310, exits the tubing at an angle $\alpha$ as shown in FIG. 5A, the airflow 511 from the middle column 311 exits directly downwards, perpendicular to the surface 101, in a direction parallel to the Y-axis shown. Airflow 512 from the outer column 312 exits the tubing arrangement at an angle $-\alpha$.

FIG. 5B shows the operation of the seal formed by tube 110. A spray paint gun 500 generates a fan spray of paint 550 that atomizes and carries paint at high velocity to the surface 101. Some of the paint does not adhere to the surface and travels parallel to the surface and perpendicular to the fan as overspray 551. The perforations 310 in the tube 110 direct air 510 to the surface 101 and back towards the paint as air flow 511. The air flow 511 collides with the overspray 551, peeling the overspray away from the surface and back into the enclosure. Meanwhile the air flow 512 disperses into the environment and ensures the air within the enclosure is refreshed, while the air flow 511 fills the gap G between 510 and 512.

It should be noted that, the various airflow components of the invention must be balanced. The blower size and power must match the number and size of perforations and the diameters of the tubes to ensure an appropriate flow to form a seal. According to an embodiment, the length L is about 8 ft., the width W is about 6 ft., and the height H is about 2 ft., and in which the bottom tubing arrangement 110 is about 24 inches in circumference, being an anti-static polyethylene material with three columns of 0.5 inch diameter perforations spaced at 1.5 inch intervals and 30° apart. The center perforation 311 is directed directly at the surface being painted. The air exit velocity is not less than 2800 fpm when measured at the perforation. The blowers 130 are a pair of Plastec30's driven by Gast 1.7 hp air motors. The motor air feeds are 8 feet of 0.5 inch air-line fed by one 100 foot long 1.5 inch hose at 100 psi. Standard air-tool lubricators at the air motors provide air motor lubrication. The filters 160 are common 2 inch tackified polyester paint booth filters attached to the apparatus with strips of hook tape with the filter forming the loop portion of a hook-and-loop fastener. The painter's access window 150 is 20 inch by 23 inch. The tubing arrangement 120 at the window 150 is 12 inch circumference anti-static polyethylene with a single column of 0.5 inch diameter perforations 320 at 1.5 inch spacing about three sides of the window's perimeter and angled 45 degrees in towards the window. The window tubing arrangement 120 is fed from the rear side of the blowers 130. The operator window 150 inflow is about 200 fpm. The device 100 captures 95% to 98% of overspray (by volume) when the gap G between the bottom tubing arrangement 110 and the surface 101 is between 2 inches and 6 inches. Greater air flow, or better directed air flow, would allow greater capture range.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. An apparatus for the redirection and capture of paint overspray and airborne particulates at a surface being painted, comprising:

a top tubing arrangement;

a bottom tubing arrangement;

an enclosure comprising:

a top portion having a top opening within the top portion, wherein top tubing arrangement is positioned at the top opening;

a bottom portion, wherein the entirety of the bottom portion forms a bottom opening, wherein the bottom tubing arrangement is positioned at the bottom opening;

a plurality of side portions between the top portion and the bottom portion;

a plurality of filters within the enclosure;

one or more blowers connected to each of the top tubing arrangement and the bottom tubing arrangement, wherein the bottom tubing arrangement includes a plurality of perforations for directing air from the blower towards said surface to be painted, for creating a pneumatic seal between the apparatus and said surface being painted, for capturing said paint overspray and airborne particulates, wherein in the bottom tubing arrangement, the plurality of perforations for directing air from the blower towards said surface includes a plurality of columns of perforations including;

an inner column of perforations;

an outer column of perforations; and, a middle column of perforations between the inner and outer columns of perforations, wherein the middle column of perforations are positioned so that air is directed directly downwards in a Y-direction, substantially perpendicular to the surface, and wherein the inner column of perforations are oriented so that air is directed at an angle $\alpha$ with respect to the Y-direction, and wherein the outer column of perforations are oriented so that air is directed at an angle $-\alpha$ with respect to the Y-direction, and wherein $\alpha$ is about 30°.

2. The apparatus of claim 1, wherein the top tubing arrangement comprises a single top column of perforations for directing air from the blower inwards the enclosure and across the top opening, wherein the single top column of perforations are oriented so that air is directed at an angle $\beta$ with respect to the Y-direction, wherein $\beta$ is about 45°.

3. The apparatus of claim 2, wherein the apparatus is a lightweight apparatus in which the enclosure is substantially rectanguloid.

4. The apparatus of claim 3, wherein apparatus has a length of about 4 ft. to about 12 ft., a width of about 4 ft. to about 8 ft., and a height of about 1.0 ft. to about 3 ft.

* * * * *